US009689209B2

(12) United States Patent
Adam

(10) Patent No.: US 9,689,209 B2
(45) Date of Patent: Jun. 27, 2017

(54) LARGE GAUGE CONCENTRIC UNDERREAMER

(75) Inventor: Mark Adam, Houston, TX (US)

(73) Assignee: NOV Downhole Eurasia Limited, Stonehouse (GB)

( * ) Notice: Subject to any disclaimer, the term of this patent is extended or adjusted under 35 U.S.C. 154(b) by 914 days.

(21) Appl. No.: 13/977,354

(22) PCT Filed: Dec. 29, 2011

(86) PCT No.: PCT/GB2011/001778
§ 371 (c)(1),
(2), (4) Date: Sep. 13, 2013

(87) PCT Pub. No.: WO2012/089999
PCT Pub. Date: Jul. 5, 2012

(65) Prior Publication Data

US 2014/0008128 A1 Jan. 9, 2014

(30) Foreign Application Priority Data

Dec. 29, 2010 (GB) ..... 1022040.8

(51) Int. Cl.
*E21B 10/32* (2006.01)

(52) U.S. Cl.
CPC ..... *E21B 10/32* (2013.01)

(58) Field of Classification Search
None
See application file for complete search history.

(56) References Cited

U.S. PATENT DOCUMENTS

| | | | |
|---|---|---|---|
| 904,344 | A | 11/1908 | Maples |
| 1,302,058 | A | 4/1919 | Layne et al. |
| 1,391,626 | A | 9/1921 | Oilthorpe et al. |
| 1,485,642 | A | 4/1922 | Stone |
| 1,667,190 | A | 4/1928 | Campbell |
| 1,810,201 | A | 12/1928 | Campbell |
| 1,728,069 | A | 9/1929 | Meijer |
| 1,897,206 | A | 2/1933 | McCann |
| 1,902,174 | A | 3/1933 | Lewis et al. |
| 2,122,863 | A | 7/1938 | Howard et al. |
| 2,179,010 | A | 11/1939 | Creighton et al. |

(Continued)

FOREIGN PATENT DOCUMENTS

| | | |
|---|---|---|
| EP | 0301890 | 2/1989 |
| EP | 0353962 | 7/1990 |

(Continued)

OTHER PUBLICATIONS

Search Report for Patent Application No. GB1022040.8 dated Feb. 22, 2011, 5 pages.

(Continued)

*Primary Examiner* — Caroline Butcher
(74) *Attorney, Agent, or Firm* — Conley Rose, P.C.

(57) ABSTRACT

A downhole tool and associated methods. The downhole tool includes a body with a throughbore; at least one extendable cutting member; and an actuation member. The actuation member is operatively associated with the extendable cutting member and movable relative to the body to extend the cutting member laterally from the body along an extension axis. The extension axis is offset from a radius of the body.

33 Claims, 6 Drawing Sheets

(56) References Cited

U.S. PATENT DOCUMENTS

| | | | |
|---|---|---|---|
| 2,712,434 | A | 7/1955 | Giles et al. |
| 2,859,943 | A | 11/1958 | Chadderdon |
| 2,890,022 | A | 6/1959 | Brown, Jr. |
| 3,049,185 | A | 8/1962 | Herbold |
| 3,068,946 | A | 12/1962 | Frisby et al. |
| 3,237,705 | A | 3/1966 | Williams |
| 3,376,942 | A | 4/1968 | Van Winkle |
| 3,429,387 | A | 2/1969 | Brown |
| 3,431,989 | A | 3/1969 | Waterman et al. |
| 3,433,313 | A | 3/1969 | Brown |
| 3,561,549 | A | 2/1971 | Garrison et al. |
| 3,753,470 | A | 8/1973 | Lagerstrom et al. |
| 3,880,246 | A | 4/1975 | Farris |
| 4,031,974 | A | 6/1977 | Peterson |
| 4,080,010 | A | 3/1978 | Young |
| 4,185,704 | A | 1/1980 | Nixon, Jr. |
| 4,220,213 | A | 9/1980 | Hamilton |
| 4,465,147 | A | 8/1984 | Feenstra et al. |
| 4,729,438 | A | 3/1988 | Walker et al. |
| 4,807,708 | A | 2/1989 | Forrest et al. |
| 4,889,197 | A | 12/1989 | Boe |
| 4,915,172 | A | 4/1990 | Donovan et al. |
| 4,982,802 | A | 1/1991 | Warren et al. |
| 5,050,692 | A | 9/1991 | Beimgraben |
| 5,094,304 | A | 3/1992 | Briggs |
| 5,117,926 | A | 6/1992 | Worrall et al. |
| 5,141,062 | A | 8/1992 | Anderson |
| 5,313,829 | A | 5/1994 | Paslay et al. |
| 5,368,114 | A | 11/1994 | Tandberg et al. |
| 5,402,677 | A | 4/1995 | Paslay et al. |
| 5,423,389 | A | 6/1995 | Warren et al. |
| 5,468,114 | A | 11/1995 | Boe |
| 5,495,899 | A | 3/1996 | Pastusek et al. |
| 5,979,570 | A | 11/1999 | McLoughlin et al. |
| 6,116,356 | A | 9/2000 | Doster et al. |
| 6,205,851 | B1 | 3/2001 | Jogi |
| 6,279,670 | B1 | 8/2001 | Eddison et al. |
| 6,325,162 | B1 | 12/2001 | Eppink et al. |
| 6,439,318 | B1 | 8/2002 | Eddison et al. |
| 6,508,317 | B2 | 1/2003 | Eddison et al. |
| 6,668,949 | B1 | 12/2003 | Rives |
| 6,732,817 | B2 | 5/2004 | Dewey et al. |
| 6,739,416 | B2 | 5/2004 | Presley et al. |
| 7,152,702 | B1 | 12/2006 | Bhome et al. |
| 7,185,715 | B2 | 3/2007 | Krueger et al. |
| 7,252,163 | B2 | 8/2007 | Ollerenshaw et al. |
| 7,493,971 | B2 | 2/2009 | Nevlud et al. |
| 7,584,811 | B2 | 9/2009 | Fanuel et al. |
| 7,658,241 | B2 | 2/2010 | Lassole et al. |
| 7,681,666 | B2 | 3/2010 | Radford et al. |
| 7,703,553 | B2 | 4/2010 | Eddison et al. |
| 7,757,787 | B2 | 7/2010 | Mackay et al. |
| 7,823,663 | B2 | 11/2010 | Eddison |
| 2001/0047884 | A1 | 12/2001 | Eddison |
| 2002/0185315 | A1 | 12/2002 | McLoughlin et al. |
| 2003/0111236 | A1 | 6/2003 | Serafin |
| 2007/0102201 | A1 | 5/2007 | Savignat |
| 2007/0240906 | A1 | 10/2007 | Hill |
| 2007/0289778 | A1 | 12/2007 | Watkins et al. |
| 2008/0070038 | A1 | 3/2008 | Vincent et al. |
| 2008/0257608 | A1 | 10/2008 | Fanuel et al. |
| 2010/0089583 | A1 * | 4/2010 | Xu ..... E21B 10/322 166/298 |
| 2010/0116556 | A1 | 5/2010 | Buske |

FOREIGN PATENT DOCUMENTS

| | | |
|---|---|---|
| EP | 0550254 | 10/1996 |
| FR | 1249499 | 12/1960 |
| GB | 302900 | 2/1930 |
| GB | 2147033 | 5/1985 |
| GB | 2294071 | 4/1996 |
| GB | 2308608 | 2/1997 |
| GB | 2337066 | 11/1999 |
| GB | 2386387 | 9/2003 |
| GB | 2401284 | 11/2004 |
| GB | 2411419 | 8/2005 |
| GB | 2434389 | 7/2007 |
| GB | 2446294 | 8/2008 |
| GB | 2450433 | 12/2008 |
| NO | 330479 | 4/2011 |
| WO | 9923346 | 5/1999 |
| WO | 0163087 | 8/2001 |
| WO | 02064939 | 8/2002 |
| WO | 03008754 | 1/2003 |
| WO | 2004048744 | 6/2004 |
| WO | 2004097163 | 11/2004 |
| WO | WO 2004097163 A1 * | 11/2004 |
| WO | 2004104360 | 12/2004 |
| WO | 2004109052 | 12/2004 |
| WO | 2005103435 | 11/2005 |
| WO | 2007017651 | 2/2007 |
| WO | 2008070052 | 6/2008 |
| WO | 2009051950 | 4/2009 |
| WO | 2011115941 | 9/2011 |

OTHER PUBLICATIONS

International Search Report and Written Opinion for PCT Application No. PCT/GB2011/001778 dated Oct. 12, 2012, 16 pages.

Response in Counterpart Patent Application No. MX/a/2009/010905 dated Nov. 27, 2012, 17 pages.

Examination Report Under Section 18(3) in counterpart Patent Application No. GB0917213.1 dated Dec. 27, 2012, 2 pages.

ReedHycalog. Improvede Bi-Center bits Tackle Smaller Hole Sizes [online], [retrieved on Jan. 10, 2013]. Retrieved from the Internet URL http://208.88.130.69/article.aspx?id=33758.

World Oil. Bit Technology keeps Pave with Operator Activity [online], [retreived on Jan. 10, 2013]. Retrieved from Internet URL http://www.worldoil.com/November-2006-Bit-technology-keeps-pace-with-operator-activity.html.

Search Report for GB Patent Application No. GB0917213.1 dated Jan. 26, 2010, 1 page.

Halsey et al., "Torque Feedback Used to Cure Slip-Stick Motion," SPE 18049 (1988).

Jansen et al., Journal of Sound and Vibration 179(4):647-688 (1995).

Pavone, "Application of High Sampling Rate Downhole Measurements for Analysis and Cure of Stick-Slip in Drilling," SPE 28324 (1994).

IADC/SPE Drilling Conference, "Wellbore Enlargement for a Deepwater Casing Program: Case Study and Developments, Abstract", Mar. 2-4, 2004, Dallas, TX, pp. 1-11.

Search Report and Written Opinion for PCT Patent Application No. PCT/GB2010/000728 dated Dec. 29, 2010, 19 pages.

Amendment for European Patent Application No. EP10717716.4 dated May 31, 2013, 18 pages.

Response to European Office Action for Patent Application No. EP10717716.4 dated Oct. 12, 2012, 2 pages.

Search Report for European Patent Application No. EP1217033.4 dated Nov. 14, 2012, 7 pages.

Examination Report Under Section 18(3) for GB Patent Application No. GB0917213.1 dated Jun. 7, 2013, 2 pages.

* cited by examiner

LARGE GAUGE CONCENTRIC UNDERREAMER

CROSS-REFERENCE TO RELATED APPLICATION

This application claims the benefit of GB Patent Application No. 1022040.8, filed on Dec. 29, 2010, the entire contents of which are hereby incorporated by reference.

FIELD OF THE INVENTION

The invention relates to a downhole tool and in particular, but not exclusively, to a large gauge concentric reamer or underreamer. The invention also relates to methods of using the downhole tool.

BACKGROUND OF THE INVENTION

Bores are drilled from the surface for various purposes, such as exploration and production in the oil and gas industry. Bores may be formed with drills of an initial diameter and subsequently enlarged. For example, an initial narrow bore may be made when all characteristics of the formation to be drilled are not known, such as whether gas could be encountered whilst drilling. Upon completion of the narrow borehole, a desired greater final bore diameter may be safely achieved by a reaming operation. In other instances the initial bore diameter may be less than desired, such as due to wear of a drill bit, or encroachment by material adjacent the bore (e.g. plastic formation creep).

Bores are often lined, such as with sections of casing in the oil and gas industry to provide a continuous fluid-tight conduit for conveying fluids through the bore. Typically the casings are fixed in place by injecting cement in an annular space between the casing and the bore wall. Once a first section of bore has been lined, a subsequent section is bored, involving passing the drill bit through the casing. Consequently the drill bit has a smaller diameter than the casing and in order to drill a bore at a larger diameter, such as the same diameter of the first section of bore, an under-reamer is often mounted above the drill bit.

In addition to continuous sections of larger diameter, reamers may be used to create localized sections of larger diameter. For example, where a feature in a bore is to be placed, such as a branch or deviation, the bore diameter may be focally enlarged.

Tools used for reaming operations comprise extendable cutters that are actuated to project out from the diameter of the main body of the tool to enlarge the bore diameter. Typically the cutters are also retractable for subsequent passage through a narrower section, such as for retrieval through casing. The extent to which the cutters can extend limits the maximum diameter that can be reamed. In order to increase the maximum reamable diameter, hinged cutters are used; however the hinged constructions are relatively weak and the hinged cutters can fail leading to costly interruptions and retrieval operations.

SUMMARY OF THE INVENTION

According to an aspect of the invention there is provided a downhole tool comprising:

a body comprising a throughbore;

at least one extendable cutting member; and an actuation member operatively associated with the extendable cutting member and movable relative to the body to extend the cutting member laterally from the body along an extension axis;

wherein the extension axis is offset from a radius of the body.

Providing a downhole tool with an offset extendable cutting member enables the cutting member to be optimised for rotation of the downhole tool in a particular direction. This may be useful in circumstances where it is desired to increase the extendable length of the cutting member, such as to ream, or underream, a large gauge.

The tool may be a reamer or an undereamer, such as a concentric underreamer.

The tool may comprise a stabilizer.

The cutting member may be a cutter block, such as of a fixed block type. Downhole tools, such as reamers, with block cutters are generally more reliable and stronger than downhole tools, such as reamers, with hinged cutting members. An orientation of the cutting member relative to the body may be substantially the same in the unextended and extended configurations. For example, the longitudinal axis of the cutting member may be substantially parallel to the downhole tool longitudinal axis in the unextended and extended configurations. The orientation of the cutting member relative to the body may remain substantially the same during reconfiguration(s) between the unextended and extended configurations.

The tool may be configured to extend the cutting member laterally by sliding the cutting member along the extension axis. The body may comprise a window, the window configured for the cutting member to slide through to extend and/or retract. The cutting member may be configured to extend laterally by translation through the window.

The cutting member may comprise an offset recess for accommodating the throughbore in an unextended configuration.

The cutting member may comprise a retention portion, such as a dovetail, for retaining the cutting member to the actuation member, the retention portion being offset from the extension axis. The cutting member may comprise a single retention portion.

The cutting member may be arranged about a central axis in a direction of extension of the cutting member. The extension axis may comprise the central axis. The cutting member central axis may be offset from a central longitudinal axis of the downhole tool.

The cutting member may be offset from a central longitudinal axis of the body.

The extension axis may be offset from a central longitudinal axis of the body. The extension axis may be in a plane perpendicular to the longitudinal axis of the body. For example, the extension axis may be collinear with a non-radial chord of the body. The extension axis may be parallel to the radius of the body. Alternatively, the extension axis may be angularly offset from the radius. The extension axis may be in a non-perpendicular plane. For example, the extension axis may be offset from the radius, such as along a non-radial chord, and also at angle relative to the longitudinal axis of the tool, such as inclined towards a downhole direction.

The cutting member central axis may be parallel to the radius of the downhole tool. The cutting member central axis may be angularly offset from the radius. For example, the cutting member central axis may be collinear with a non-radial chord of the body.

The cutting member central axis may be parallel to the radius of the body. The cutting member central axis may be in a plane perpendicular to the longitudinal axis of the body.

The actuation member may be configured to extend multiple cutting members simultaneously. The actuation member may be a cam member. The downhole tool may be configured to extend the cutting member by movement of the actuation member in the longitudinal direction of the downhole tool.

The cutting member may comprise multiple cutting elements.

The cutting elements may be arranged in rows. A first row may be located on a first side of the cutting member central axis and a second row may be located on a second side of the cutting member central axis.

The cutting member may be configured such that the cutting member central axis, or an extrapolation thereof, does not intersect the downhole tool central longitudinal axis.

The cutting member central axis may be colinear with a portion of a non-radial chord of a cross-section substantially perpendicular to the longitudinal axis of the downhole tool.

According to an aspect of the invention there is provided a downhole tool with at least one extendable cutting member for reaming a bore, the cutting member comprising a first side portion and a second side portion; wherein the first side portion is substantially greater than the second side portion.

Providing a downhole tool with an extendable cutting member that has a first side portion greater than a second side portion enables the cutting member to be optimised for rotation of the downhole tool in a particular direction. This may be useful in circumstances where it is desired to increase the extendable length of the cutting member.

The first side portion being substantially greater than the second side portion may comprise the first side portion being longer than the second side portion in a direction of extension of the cutting member. The direction of extension may be along an extension axis. The first side portion may be arranged on a first side of the extension axis and the second side portion may be arranged on a second side of the extension axis.

The first side portion may be substantially greater than the second side portion at a position along the cutting member's axial length. The longitudinal axis of the cutting member may be substantially parallel to a longitudinal axis of the tool.

The first side portion may be substantially greater than the second side portion substantially along the axial length of the cutting member.

The longitudinal axis of the cutting member may be substantially perpendicular to the direction of extension of the cutting member.

The extension axis may be offset from a central longitudinal axis of the downhole tool.

Alternatively, the extension axis may intersect the central longitudinal axis of the downhole tool.

The first side portion may extend further than the second side portion in the direction of extension.

The first side portion may be substantially greater than the second side portion at a cross-section through the cutting member, the cross-section perpendicular to the cutting member's longitudinal axis.

The cross-section may be asymmetrical about the extension axis.

The first side portion may be a forward side portion in a direction of rotation of the tool. Alternatively, the first side portion may be a rearward side portion in a direction of rotation of the tool.

The first side portion may be on a first side of a cutting member plane and the second side portion may be on a second side of the cutting member plane.

The cutting member plane may be parallel to the direction of extension and parallel to the longitudinal axis of the tool.

The cutting member plane may intersect a center of the cutting member.

The downhole tool may further comprise a main body, the main body configured to receive the cutting member.

The first and/or second side portions may be configured to transfer load between the cutting member and the main body.

The first and/or second side portions may be configured to support the cutting member, such as during rotation of the tool. For example the first side portion may comprise a first support face. Additionally, or alternatively, the second side portion may comprise a second support face.

The first support face may be configured to abut a first receiving face of the main body. The second support face may be configured to abut a second receiving face of the main body.

The downhole tool may further comprise a central longitudinal member, such as a throughbore.

The length of the first side portion may be greater than a radial distance between the central longitudinal member and an external diameter of the main body.

The cutting member may further comprise a cutting portion and a rear portion, the rear portion distal from the cutting portion in the direction of extension of the cutting member.

The cutting member may be configured to position the rear portion rearwards of the centre of the downhole tool in an unextended configuration.

Rearwards is understood to be a direction substantially opposite to the direction of extension.

Providing a cutting member with a rear portion positioned rearwards of the center of the downhole tool in an unextended configuration enables the cutting member to have an increased length in the direction of extension. An increased length in the direction of extension allows an increased maximum diameter of a reamed bore; in particular, relative to the diameter of the downhole tool. The increased length may be relative to a cutting member with a rear portion aft of the center of the downhole tool in an unextended configuration.

The direction of extension may be substantially radial with respect to the longitudinal axis of the downhole tool.

The longitudinal axis of the downhole tool may be configured to be substantially parallel to the bore.

The direction of extension may be angled with respect to the longitudinal axis of the downhole tool. For example, the direction of extension may be substantially radial when viewed in a cross-section perpendicular to the longitudinal axis of the tool. Additionally, or alternatively, the direction of extension may be at an angle between 0 and 90 degrees when viewed in a cross-section parallel to the longitudinal axis of the tool.

The extension axis may be a central extension axis, passing through the center of the cutting member. The center of the cutting member may be located equidistant to the first and second side portions of the cutting member when viewed in a cross-section perpendicular to the longitudinal axis. The cross-section may be at a location along the longitudinal axis, such as at a leading end region.

The extension axis may be linear. The extension axis may be substantially perpendicular to the downhole tool longitudinal axis. The extension axis may be substantially straight. Alternatively, the extension axis may be curved; such as a helical axis. The helical axis may be a cylindrical helical axis. Additionally or alternatively the helical axis may be a conical helical axis.

The cutting member may be configured to position the rear portion rearwards of a downhole tool central plane, the central plane substantially perpendicular to the direction of extension and extending along the central longitudinal axis of the downhole tool.

The rear portion may be at a longitudinal region of the cutting member.

For example, the rear portion may be located towards a leading end of the cutting member.

A dimension of the cutting member in the direction of extension may be greater than a radius of the downhole tool. The radius of the downhole tool may be an external radius, such as a distance from the central longitudinal axis of the tool to an external portion of the tool. Additionally or alternatively, a dimension of the cutting member in a plane perpendicular to the longitudinal axis of the downhole tool may be greater than the radius of the downhole tool.

The dimension may be a distance between a foremost portion of the cutting member and an aft portion of the cutting member in the direction of extension (e.g. a length/height).

The dimension may be a distance in the direction of extension between projections in the downhole tool axial direction of a foremost portion of the cutting member and an aft portion of the cutting member (e.g. a total length/total height).

The cutting member may be configured to position the rear portion adjacent the central longitudinal member in the unextended configuration at least one point along the length of the cutting member in the longitudinal direction of the downhole tool.

At the at least one point along the length of the cutting member in the longitudinal direction of the downhole tool, the rear portion may be configured to substantially overlap the central longitudinal member in the direction of extension in the unextended configuration.

The cutting member may comprise a support portion.

The support portion may comprise the rear portion.

The support portion may be configured to maintain the angular position of the cutting member during a reaming operation. For example, the cutting member support portion may be configured to transfer rotational force between the cutting member and the main body.

The support portion may be configured to support the cutting member in the tool when the tool is rotated, such as during a cutting or reaming operation. For example, the support portion may comprise an asymmetrical cross-section in a plane perpendicular to the longitudinal axis.

The main body may be configured to support the cutting member when the tool is rotated. For example, the main body may comprise a support portion, the support portion including a support face for contacting a corresponding portion of a cutting member, such as a face corresponding to the first side portion of the cutting member.

The support face may have a greater cross-sectional length, such as a length or height in the direction of extension, than a radial thickness of the main body. For example, the support face may have a greater cross-sectional length than a radial distance between the central longitudinal member and the external diameter of the main body. For example, a radial separation of the throughbore from the external diameter of the main body.

The support face may extend further than the radius of the downhole tool on the unextended configuration.

Providing a tool with a main body with a support face that is longer in a plane perpendicular to the longitudinal axis of the tool helps to provide rotational support to the cutting member when the tool is rotated about its longitudinal axis, such as during a reaming operation. Similarly, providing a cutting member with a greater support portion length in an extension plane perpendicular to the longitudinal axis provides more rotational support during rotation of the tool.

The support face may be planar.

Additionally or alternatively, the support face may be curved (e.g. helically curved).

The cutting member may be configured in the unextended configuration to receive a second cutting member. For example, a first cutting member may comprise a recess, the recess configured to receive a rear portion of the second cutting member in the unextended configuration.

The first and/or second portion(s) may be configured to receive a rear portion of a second cutting member. For example, the side portion may comprise the recess.

The second side portion of the first cutting member may be configured to receive a first side portion of the second cutting member in the unextended configuration.

The main body may be configured to receive multiple cutting members.

For example, the main body may be configured to receive two cutting members.

The cutting member rear portion may have an asymmetrical cross-section about the central axis of extension, the cross-section in a plane perpendicular to the longitudinal axis of the tool. The multiple cutting members may be arranged substantially in a plane perpendicular to the downhole tool longitudinal axis. The multiple cutting members may be arranged at substantially the same axial position along the downhole tool longitudinal axis. For example, the downhole tool may comprise three cutting members, the cutting members arranged evenly around the downhole tool central longitudinal axis at a predetermined position. Providing three cutting members circumferentially arranged provides a self-centering tool such that a bore may be concentrically enlarged by a reaming process. The longitudinal position of the cutter(s) may vary with respect to the main body; for example when the cutter(s) are retracted and/or extended.

The cutting member may be configured to be rotationally driven in a particular direction. For example, the cutting member may comprise a greater strength and/or stiffness in a particular direction of rotation, such as clockwise. The actuation member may be configured to support the cutting member for drive in a particular direction. For example, the actuation member may comprise a greater strength and/or stiffness in a particular direction of rotation, such as clockwise.

The asymmetrical cross-section may provide for an asymmetrical retention element(s). For example, the cutting member may comprise a single dovetail for retaining the cutting member to the actuation member. The asymmetrical element(s) may provide for optimization of the cutting member for rotation in a particular direction, such as in the direction of the element(s).

Each cutting member may be configured to receive a first side portion of another cutting member in the unextended configuration.

Each cutting member may be configured to receive a rear portion of another cutting member in the unextended configuration.

According to an aspect of the invention there is provided a method of operating a downhole too), the method comprising:

providing a downhole tool comprising:

a body comprising a throughbore;

at least one extendable cutting member; and an actuation member operatively associated with the extendable cutting member and movable relative to the body to extend the cutting member laterally from the body along an extension axis; and moving the actuation member relative to the body to extend the cutting member laterally from the body along the extension axis.

The method may comprise moving the actuation member relative to the body to retract the cutting member.

According to an aspect of the invention there is provided a method of reaming a bore, the method comprising providing a downhole tool comprising a main body and a cutting member, the cutting member comprising a cutting portion and a rear portion, the rear portion distal from the cutting portion in a direction of extension of the cutting member, configuring the cutting member in an unextended configuration, wherein the rear portion is positioned rearwards of the center of the downhole tool, reconfiguring the cutting member in an extended configuration, wherein the cutting portion extends radially beyond the main body, rotating the tool.

According to an aspect of the invention there is provided a method of reaming a bore, the method comprising:

providing a downhole tool comprising:

a body with a throughbore;

a cutting member; and an actuation member operatively associated with the extendable cutting member and movable relative to the body to extend the cutting member laterally from the body along an extension axis;

configuring the cutting member in an unextended configuration, wherein the cutting member is positioned adjacent the throughbore, reconfiguring the cutting member in an extended configuration, wherein the cutting portion extends laterally beyond the body, and rotating the tool.

According to an aspect of the invention there is provided a downhole tool cutting member, the cutting member comprising a cutting portion and a rear portion, the rear portion distal from the cutting portion in a direction of extension of the cutting member, wherein the cutting member is configured to position the rear portion rearwards of the center of a downhole tool in an unextended configuration.

According to an aspect of the invention there is provided a downhole tool cutting member, the cutting member comprising a cutting portion, a side portion and a rear portion, the rear portion distal from the cutting portion in a direction of extension of the cutting member and the side portion between the cutting portion and the rear portion, wherein the side portion is configured to receive a rear portion of a second cutting member in an unextended configuration in a downhole tool.

According to an aspect of the invention there is provided a downhole tool cutting member for mounting in a downhole tool, the cutting member configured to be mounted for extension along an axis offset from a central longitudinal axis of the downhole tool.

The axis may be offset from a radius perpendicular to the downhole tool central longitudinal axis. The axis may be parallel to the radius perpendicular to the downhole tool central longitudinal axis.

According to an aspect of the invention there is provided a downhole tool cutting member for mounting in a downhole tool, the cutting member configured to be mounted for extension along an axis offset from a radius the downhole tool.

According to an aspect of the invention there is provided a downhole tool actuation member, the actuation member configured to be operatively associated with an extendable cutting member and movable relative to a downhole tool body to extend the cutting member laterally from the body along an extension axis;

wherein the actuation member comprises a cutting member retention portion offset from a radius of the actuation member.

The cutting member retention portion may comprise a single cutting member retention element. Accordingly the actuation member may comprise a skewed retention portion. The actuation member may comprise a cutting member retention portion for multiple cutting members (e.g. three cutting members). The actuation member may comprise a single retention element for each cutting member, each retention element skewed about a longitudinal axis of the actuation member in a same direction (e.g. clockwise).

The invention includes one or more corresponding aspects, embodiments or features in isolation or in various combinations whether or not specifically stated (including claimed) in that combination or in isolation. For example, it will readily be appreciated that features recited as optional with respect to one aspect may be additionally applicable with respect to any of the other aspects, without the need to explicitly and unnecessarily list those various combinations and permutations here.

The above summary is intended to be merely exemplary and non-limiting.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1A:
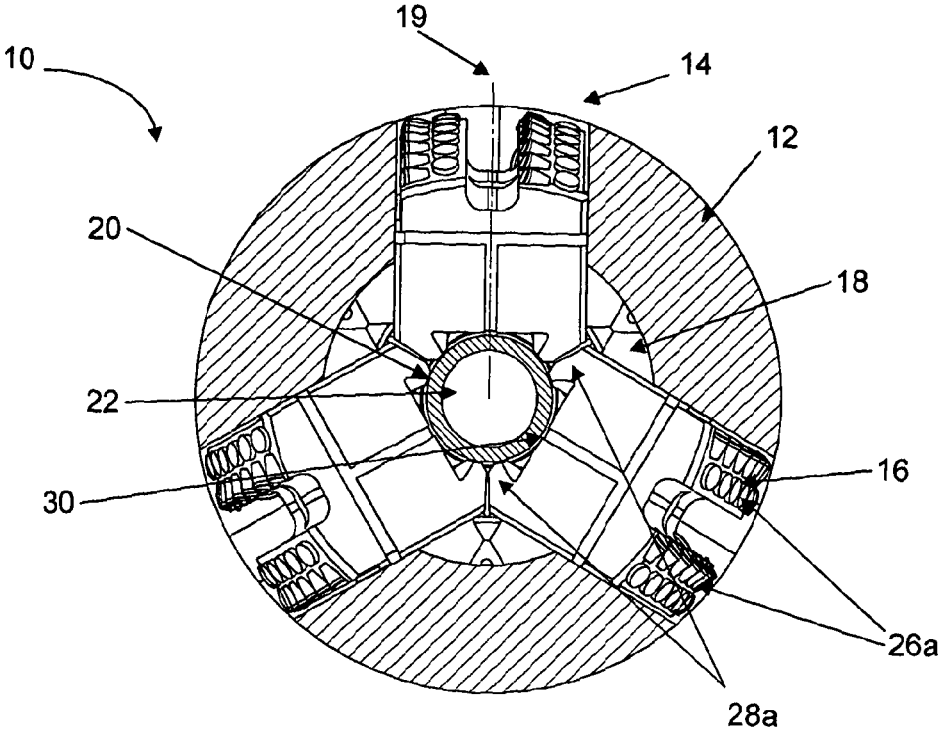
FIG. 1*a* is a sectional view of an existing reamer in an unextended configuration.
Figure 1B:
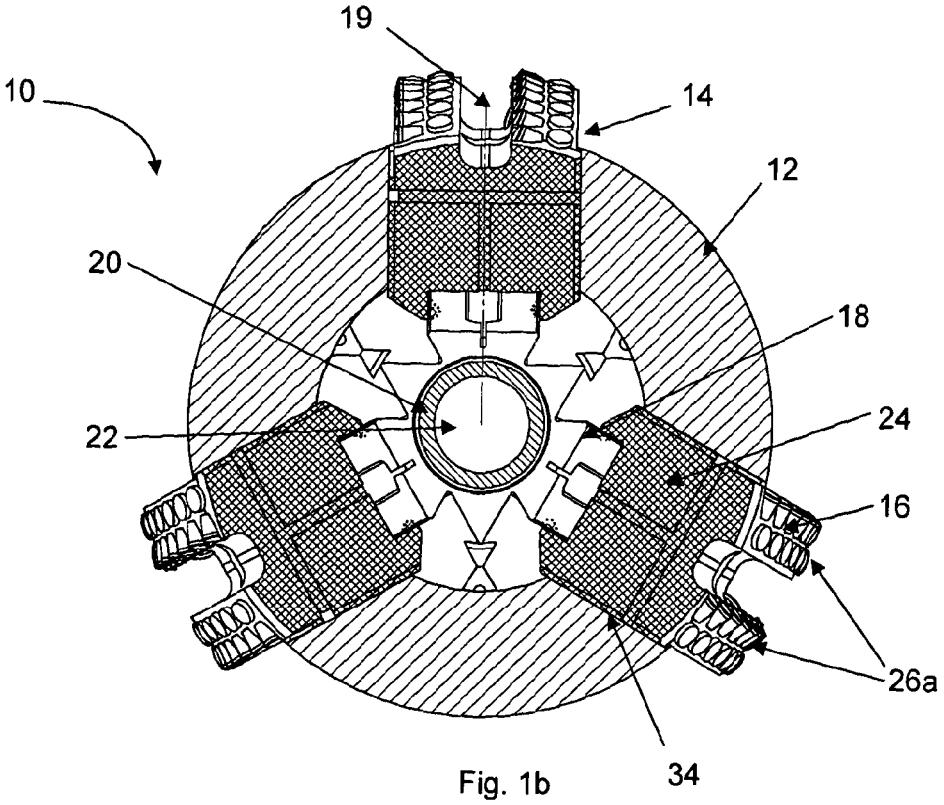
FIG. 1*b* is a sectional view of an existing reamer in an extended configuration.

Reference is first made to FIGS. 1*a* and 1*b* of the drawings, which show sectional views of a conventional reamer, such as supplied by the applicant. The reamer 10 is adapted to form part of a drill string and will be positioned towards the lower end of the string, above a drill bit. The reamer 10 comprises an elongate tubular body 12 formed from a number of connected parts. Windows 14 in the body 12 accommodate radially movable cutters 16 which co-operate with a corresponding cam member 18 arranged about a central member 20 with a throughbore 22, whereby axial movement of the cam member 18 causes the respective cutters 16 to radially extend and retract along a central axis of extension 19.

FIG. 1*a* shows the reamer 10 with the cutters 16 in a retracted configuration, while FIG. 1*b* shows the reamer 10 with the cutters 16 in an extended configuration. FIG. 1*b* further shows a hatched cross-sectional area 24 of the cutters 16 retained in the body 12 when extended. The cross-sectional area 24 indicates the load-bearing cross-section of the cutters 16 for transferring forces between the cutters 16 and the body 12 during reaming.

Figure 1C:
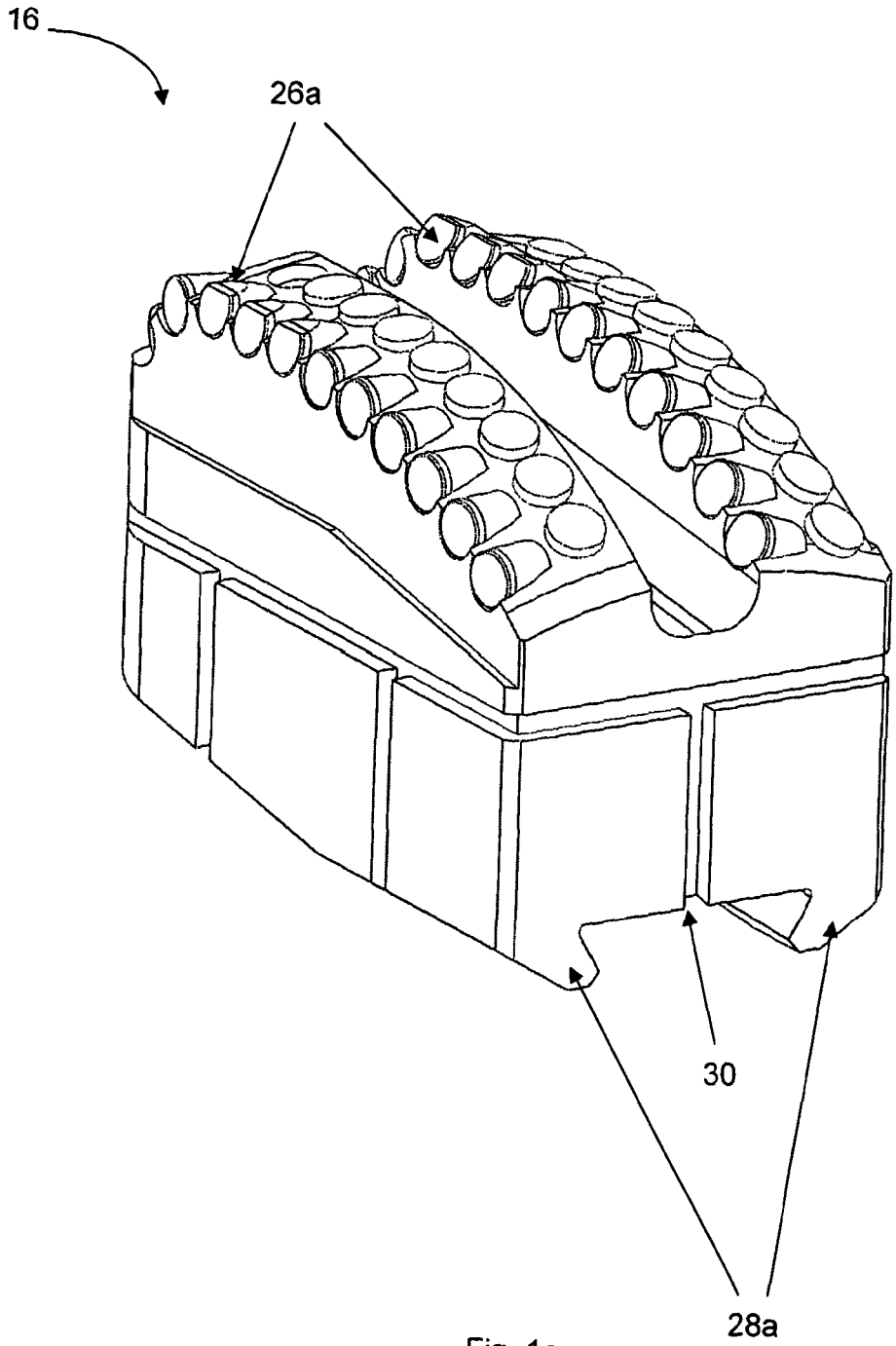
FIG. 1*c* is a perspective view of an existing cutting member.

FIG. 1*c* shows a cutter 16 in detail. The cutter 16 comprises abrasive cutting elements 26*a* and two rear portions 28*a* for retaining the cutter 16 on the cam member 18. As can be seen in FIG. 1*a*, the cutters 16 in the retracted configuration abut the central member 20. The maximum retracted position of the cutters 16 is limited by the central rear portion 30 abutting the central member 20 and by the rear portions 28*a* of each cutter 16 abutting the rear portions 28*a* of the other cutters 16, and the central member 20. Consequently the maximum extension stroke of the cutters 16 is limited by the distance between the central member 20 and the external diameter of the body 12; and by the separation of the rear portions 28*a* of the cutters 16. The rear portions 28*a* comprise dovetails that slide relative to the cam member 18 to move the cutters 16 radially inward or outward depending on the axial direction of the movement of the cam member 18. The dovetails of the rear portions 28*a* shown in FIG. 1*b* are partially obscured by corresponding dovetail portions of the cam member 18 that taper inwardly towards the viewing position of FIG. 1*b*, as indicated by the dotted lines.

Figure 2A:
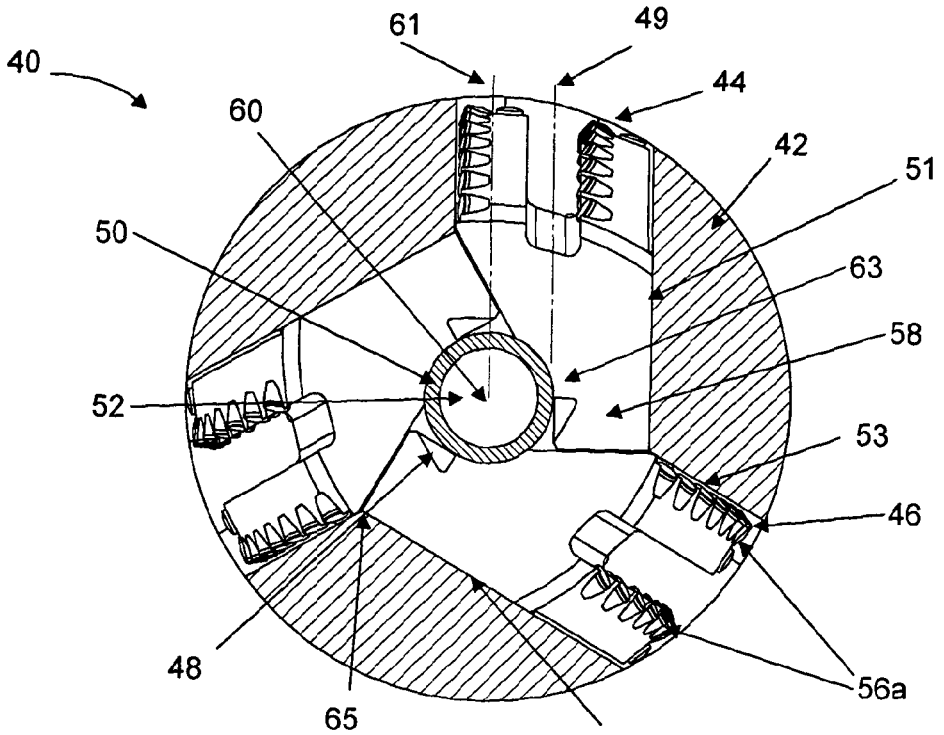
FIG. 2*a* is a sectional view of a reamer in accordance with an embodiment of the present invention in an unextended configuration.
Figure 2B:
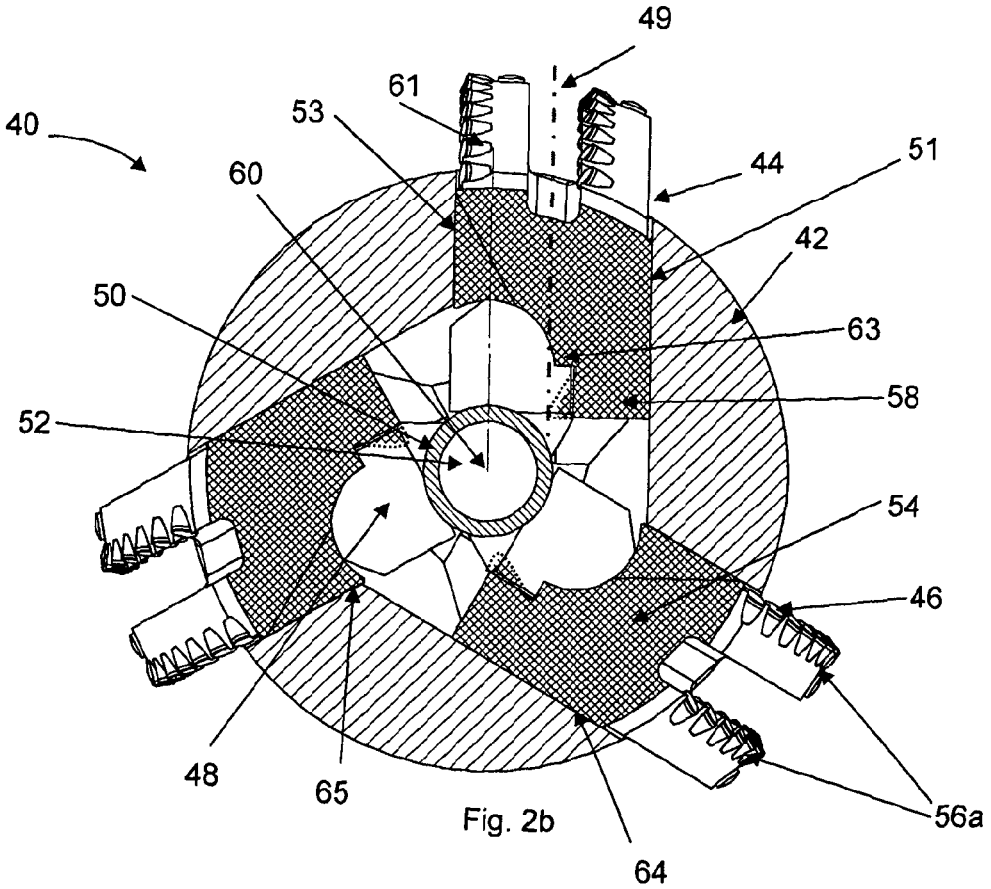
FIG. 2*b* is a sectional view of the reamer of FIG. 2*a* in an extended configuration.

Reference is now made to FIGS. 2*a* and 2*b* of the drawings, which illustrate an underreamer 40 in accordance with an embodiment of the present invention. The underreamer 40 comprises laterally extendable cutters 46 with first and second side portions 51, 53 respectively. The cutters 46 comprise cutting elements 56*a* and rear portions 58, the rear portions 58 distal from the cutting elements 56*a* in the directions of extension of the cutters 46 depicted by central axes 49. The first side portions 51 are longer than the second side portions 53. As will be described, asymmetrical side portions 51, 53 enable the cutters 46 to be optimally supported during rotation of the underreamer 40. The longer side 51 enables the cutter 46 to extend further. For example, a reamer 10 with cutters 16 of FIGS. 1*a* and 1*b* may ream with an opening ratio of between about 16% to about 21%. Whereas, a underreamer 40 of the present invention, with cutters such as those of FIGS. 2*a* and 2*b*, may be able to ream with an opening ratio of about 31%. In the embodiment shown, the underreamer 40 is configured to position the rear portions 58 rearwards of the center 60 of the underreamer 40 in a retracted configuration.

The underreamer 40 comprises an elongate tubular body 42, that can be formed from a number of connected parts. Windows 44 in the body 42 accommodate the extendable cutters 46 which co-operate with corresponding cam members 48 arranged about a central member 50 with a throughbore 52, whereby axial movement of the cam members 48 causes the respective cutters 46 to extend and retract along a central axis of extension 49.

The cutters 46 are mounted offset in the body 42. Accordingly, a projection of the central axis of extension 49 of a cutter 46 does not intersect the center 60 of the underreamer 40. The central axis of extension 49 is offset from a radius 61 of the underreamer 40, as defined by a radius of the body. In the retracted configuration of FIG. 2*a*, the rear portion 58 and a central rear portion 63 are positioned adjacent the central member 50 such that the maximum retracted position of the cutter 46 is determined by the abutment of the rear portion 58 of a first cutter 46 with a receiving portion 62 of an adjacent cutter 46.

FIG. 2*b* shows the cutters 46 in an extended configuration, the cutters 46 having been extended along the axis 49 by the longitudinal movement of the cam 48. In FIG. 2*b* the hatched cross-sectional area 54 shows the cross-section of the cutters 46 retained in the body 42 when extended. The cross-sectional area 54 indicates the load-bearing cross-section of the cutters 46 for transferring forces between the cutters 46 and the body 42 during reaming. The cross-section shown is towards a leading end of the cutter 46 in the direction of longitudinal travel of the underreamer 40 into the bore, corresponding to the longitudinal axis of the reamer. The cutters 46 have rear portions 58 that comprise single dovetails that slide relative to the cam member 48 to move the cutters 46 laterally inward or outward depending on the axial direction of the movement of the cam member 48. The dovetails of the rear portions 58 shown in FIG. 2*b* are partially obscured by corresponding singular dovetail portions of the cam member 48 that taper inwardly towards the viewing position of FIG. 2*b*, as indicated by the dotted lines. Offsetting the cutter 46 allows the cutters 46 to be extended further from the body 42 in the extended configuration of FIG. 2*b* than would be possible if the cutters 46 were not offset. Accordingly, the underreamer 46 can ream large gauges, such as enlarging bores by more than 25%; typically 31% or more; compared to a reamer 10 of FIG. 1*b* that may be restricted to gauges in the region of 21% enlargement or less.

The longer first side portion 51 of the cutter 46 enables the cross-sectional area 54 of FIG. 2*b* to be greater than the cross-sectional area 24 of FIG. 1*b*. Furthermore the maximum supported length 64 parallel to the direction of extension 49 in FIG. 2*b* is greater than the maximum supported length 34 of FIG. 1*b*. Providing an increased cross-sectional support area 54 and a greater support length 64 allows greater forces associated with greater extension of the cutters 46 to be transferred to the body 42. The stresses on the cutters 46 and the body 42 are reduced for similar forces. The maximum radial extension of the cutters 46 relative to the body 42 in FIG. 2*b* is greater than the maximum radial extension of the cutters 16 relative to the body 12 in FIG. 1*b*. FIGS. 2*a* and 2*b* also show the maximum body 42 thickness at a point 65 in the cross-section shown. The support length 64 is greater than the maximum body 42 thickness, thus enabling better support of the cutters 46.

Figure 3A:
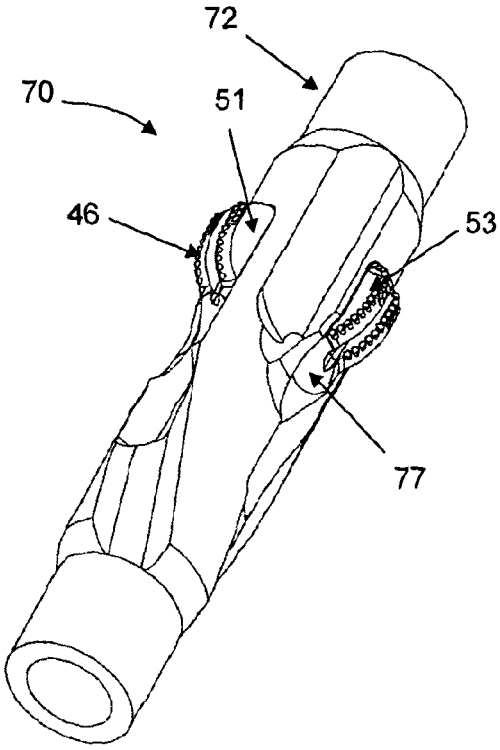
FIG. 3*a* is a perspective view of a reamer in accordance with another embodiment of the invention in the extended configuration.
Figure 3B:
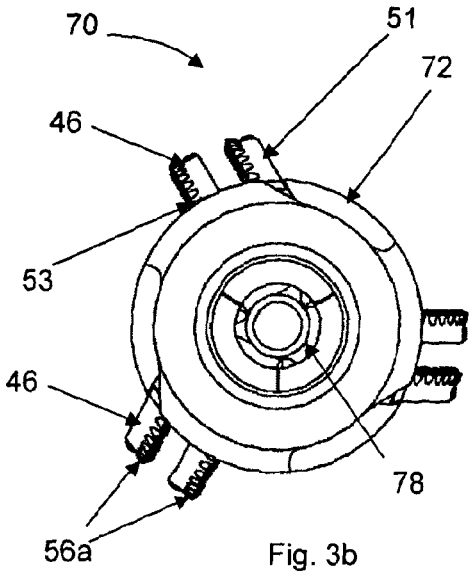
FIG. 3*b* is an end view of the reamer of FIG. 3*a* in the extended configuration.
Figure 3C:
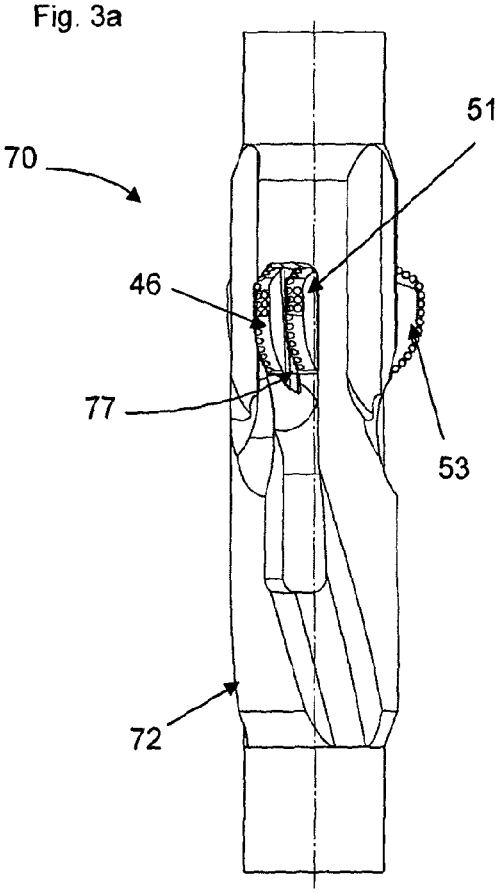
FIG. 3*c* is an orthogonal view of the reamer of FIG. 3*a* in the extended configuration.
Figure 3D:
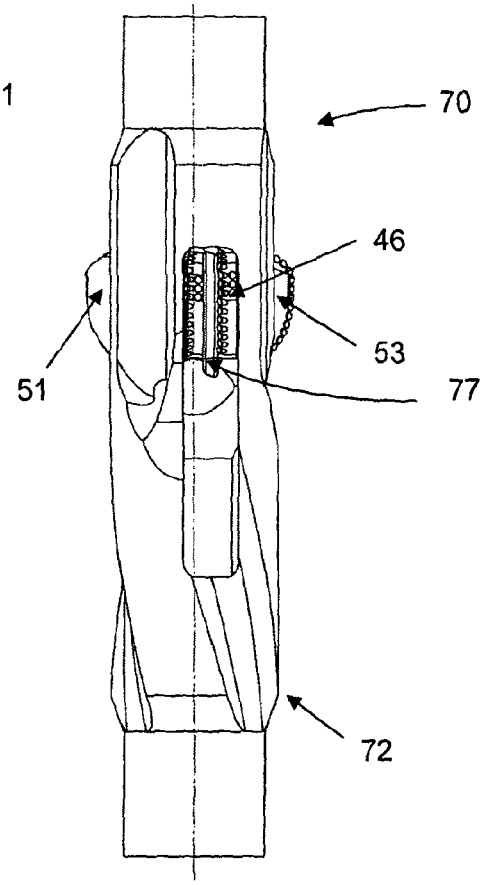
FIG. 3*d* is another orthogonal view of the reamer of FIG. 3*a* in the extended configuration.

FIG. 3*a* shows a perspective view of an underreamer 70 in accordance with another embodiment of the invention. The underreamer 70 comprises similar features such as the cutters 46 to the reamer of FIG. 2*a*. The cutters 46 are shown in a fully extended configuration in FIGS. 3*a*, 3*b*, 3*c* and 3*d*. The underreamer 70 further comprises a secondary retraction mechanism 77, the cutters 46 retractable from the fully extended configuration of FIGS. 3*a* to 3*d* by axial movement of the cutters relative to a body 72.

Figure 4:
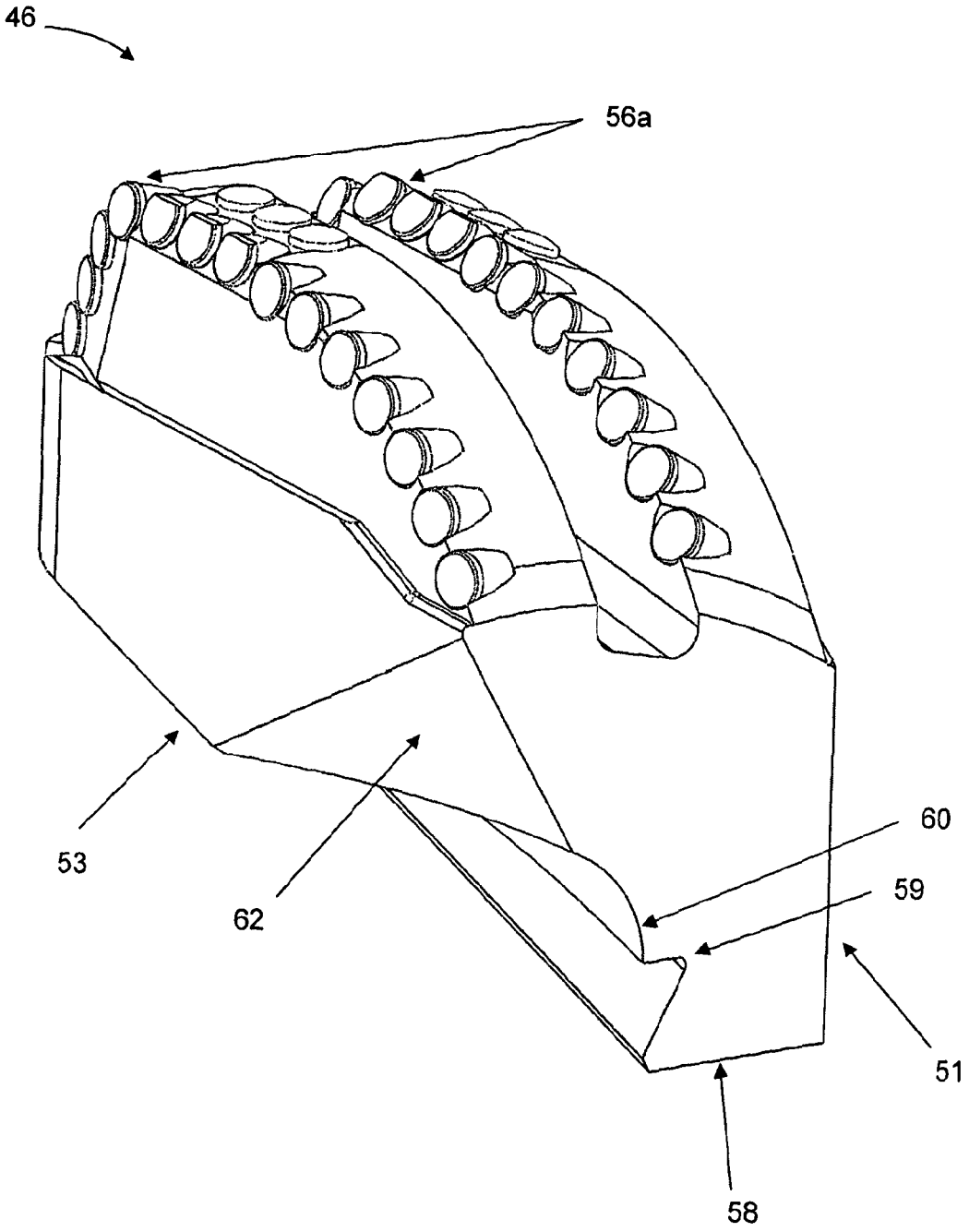
FIG. 4 is a perspective view of a cutting member in accordance with an embodiment of the present invention.

FIG. 4 shows a perspective view of a cutter 46 for use in the underreamers of FIG. 2*a* and FIG. 3*a*. The cutter comprises abrasive cutting elements 56*a* for contacting the bore walls to enlarge the bore diameter during a reaming operation. In the embodiment shown the length of the first side portion 51 is greater than the length of the second side portion 53 along the longitudinal length of the cutter 46. Accordingly, a cross-section through the cutter 46 at any point along its length would show an asymmetrical support profile similar to that of FIG. 2*b*. The cutting elements 56*a* are distal the rear portion 58 and the central rear portion 63. The cutter 46 comprises a receiving portion 62 for abutting an adjacent cutter 46 in a retracted configuration of a set of cutters. The cutter 46 further comprises a dovetail recess 59 for retaining the cutter on a cam 48. The dovetail recess 59 extends substantially longitudinally along the length of the cutter 46 such that a corresponding male dovetail feature of a cam 48 can be received. The rear portion 58 is offset from a central axis of the cutter 46 in the direction of extension such that the cutter 46 has space adjacent the central rear portion 63 for receiving the central member 50/78 of the underreamer 40/70.

Figure 5:
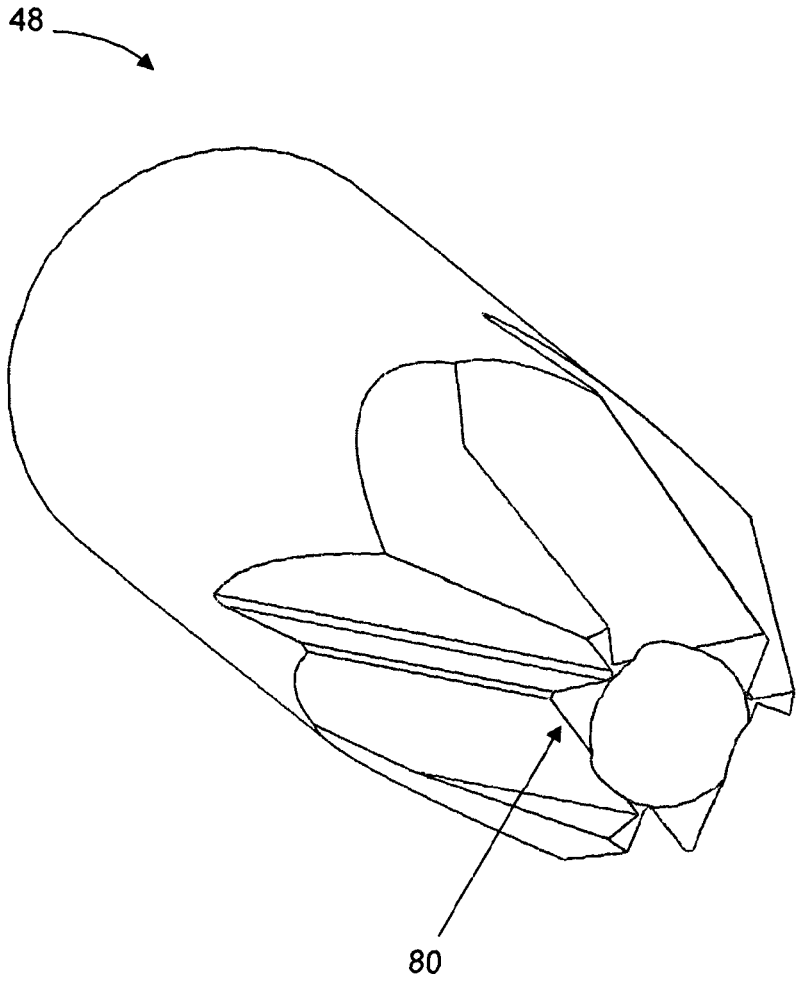
FIG. 5 is a perspective view of a cam for use in the reamer of FIG. 2*a*.

FIG. 5 shows a cam member 48 with male dovetail protrusions 80 for retaining cutters 46 on the cam member. The protrusions 80 extend longitudinally at an angle such that axial movement of the cam member 48 relative to the cutter 46 causes the cutter 46 to extend or retract laterally (e.g. radially). The cam member 48 comprises a single dovetail portion for each cutter 46, such that the dovetail portion of the cutter can be offset, such as offset from a radius of the cam member 48 or the underreamer 40.

It will be apparent to those of skill in the art that the above described embodiment is merely exemplary of the present invention, and that various modifications and improvements may be made thereto, without departing from the scope of the invention. For example, although shown in here as an underreamer, it will be appreciated that features of the invention may be appropriately applicable to reamers or stabilizers or the like.

What is claimed is:

1. A downhole tool, comprising:

a body comprising a throughbore having a longitudinal axis;

at least one extendable cutting member; and an actuation member comprising at least one dovetail configured to interface with the at least one extendable cutting member, wherein the at least one dovetail extends longitudinally along the actuation member at an angle greater than zero degrees and less than 90 degrees with respect to the longitudinal axis such that movement of the actuation member along the longitudinal axis of the throughbore of the body extends the at least one extendable cutting member laterally from the body along an extension axis that is offset from each of a radius of the body and the longitudinal axis of the throughbore of the body.

2. The downhole tool of claim 1, wherein the downhole tool comprises a reamer.

3. The downhole tool of claim 1, wherein the downhole tool comprises an underreamer.

4. The downhole tool of claim 1, wherein the at least one extendable cutting member is a cutter block.

5. The downhole tool of claim 1, wherein an orientation of the at least one extendable cutting member relative to the body is substantially the same in an unextended configuration and an extended configuration.

6. The downhole tool of claim 1, wherein the downhole tool extends the at least one extendable cutting member laterally by sliding the at least one extendable cutting member along the extension axis.

7. The downhole tool of claim 1, wherein the body comprises a window, the window configured to allow the at least one extendable cutting member to slide through to at least one of extend and retract.

8. The downhole tool of claim 7, wherein the at least one extendable cutting member extends laterally by translation through the window.

9. The downhole tool of claim 1, wherein the at least one extendable cutting member comprises a recess offset from the extension axis for accommodating the throughbore in an unextended configuration.

10. The downhole tool of claim 1, wherein the at least one extendable cutting member comprises a retention portion for retaining the at least one extendable cutting member to the actuation member, the retention portion being offset from the extension axis.

11. The downhole tool of claim 10, wherein the retention portion is the at least one dovetail.

12. The downhole tool of claim 10, wherein the at least one extendable cutting member comprises a single retention portion.

13. The downhole tool of claim 1, wherein the at least one extendable cutting member is arranged about the longitudinal axis of the throughbore of the body.

14. The downhole tool of claim 1, wherein the at least one extendable cutting member comprises a first side portion and a second side portion, the first side portion arranged on a first side of the extension axis and the second side portion arranged on a second side of the extension axis; wherein the first side portion is longer than the second side portion.

15. The downhole tool of claim 14, wherein the first side portion is longer than the second side portion substantially along an axial length of the at least one extendable cutting member.

16. The downhole tool of claim 14, wherein the first side portion is longer than the second side portion at a cross-section through the at least one extendable cutting member, the cross-section perpendicular to a longitudinal axis of the at least one extendable cutting member.

17. The downhole tool of claim 16, wherein the cross-section is asymmetrical about the extension axis.

18. The downhole tool of claim 14, wherein one of the first and second side portions transfers load between the at least one extendable cutting member and the body.

19. The downhole tool of claim 14, wherein one of the first and second side portions supports the at least one extendable cutting member during rotation of the downhole tool.

20. The downhole tool of claim 14, wherein the first side portion comprises a first support face and the second side portion comprises a second support face; wherein the first support face abuts a first receiving face of the body, and the second support face abuts a second receiving face of the body.

21. The downhole tool of claim 1, wherein the actuation member is axially movable relative to the body to laterally extend and laterally retract the at least one extendable cutting member.

22. The downhole tool of claim 1, wherein the downhole tool further comprises a central longitudinal member, and wherein a dimension of the at least one extendable cutting member in a direction of extension is greater than a radial distance between the central longitudinal member and an external diameter of the body.

23. The downhole tool of claim 1, wherein the at least one extendable cutting member further comprises a cutting portion and a rear portion, the rear portion distal from a cutting portion in a direction of extension of the at least one extendable cutting member; wherein the at least one extendable cutting member positions the rear portion rearwards of a downhole tool central plane, the central plane substantially perpendicular to the direction of extension of the at least one extendable cutting member and the central plane extending along a central longitudinal axis of the downhole tool.

24. The downhole tool of claim 1, wherein a dimension of the at least one extendable cutting member in a direction of extension is greater than a radius of the downhole tool.

25. The downhole tool of claim 1, wherein a dimension of the at least one extendable cutting member in a plane perpendicular to a longitudinal axis of the downhole tool is greater than a radius of the downhole tool.

26. The downhole tool of claim 1, wherein the at least one cutting member receives at least a portion of a second cutting member when the at least one cutting member and the second cutting member are configured in an unextended configuration.

27. The downhole tool of claim 1, wherein the downhole tool comprises multiple of the at least one cutting members arranged substantially in a plane perpendicular to a downhole tool longitudinal axis.

28. The downhole tool of claim 27, wherein each of the at least one cutting members receives a first side portion of another of the at least one cutting members in an unextended configuration.

29. The downhole tool of claim 1, wherein the body comprises a support portion, the support portion including a support face for contacting a corresponding portion of the at least one cutting member and wherein the support face has a greater cross-sectional length than a radial thickness of the body; and the cross-sectional length is in a plane perpendicular to a longitudinal axis of the downhole tool.

30. A downhole tool, comprising:

a body comprising a throughbore having a longitudinal axis;

at least one extendable cutting member; and an actuation member operatively associated with the at least one extendable cutting member and movable along the longitudinal axis of the throughbore of the body to extend the at least one extendable cutting member laterally from the body along an extension axis that is offset from each of a radius of the body and the longitudinal axis of the throughbore of the body, wherein the at least one cutting member comprises a recess that receives a rear portion of a second cutting member when the at least one cutting member and the second cutting member are configured in the unextended configuration.

31. The downhole tool of claim 30, wherein a second side portion of the at least one cutting member receives the rear portion of the second cutting member when the at least one cutting member and the second cutting member are configured in the unextended configuration.

32. A method of operating a downhole tool, the method comprising:

providing the downhole tool comprising:

a body comprising a throughbore having a longitudinal axis;

at least one extendable cutting member; and an actuation member comprising at least one dovetail configured to interface with the at least one extendable cutting member, wherein the at least one dovetail extends longitudinally along the actuation member at an angle greater than zero degrees and less than 90 degrees with respect to the longitudinal axis such that movement of the actuation member along the longitudinal axis of the throughbore of the body extends the at least one extendable cutting member laterally from the body along an extension axis that is offset from each of a radius of the body and the longitudinal axis of the throughbore of the body; and moving the actuation member relative to the body to extend the at least one extendable cutting member laterally from the body along the extension axis.

33. The method of operating the downhole tool of claim 32, further comprising moving the actuation member relative to the body to retract the at least one extendable cutting member.

* * * * *